US005085284A

United States Patent [19]

Fu

[11] Patent Number: 5,085,284

[45] Date of Patent: Feb. 4, 1992

[54] HYBRID PNEUMATIC PERCUSSION ROCK DRILL

[75] Inventor: Chuen-Cheng Fu, Roanoke, Va.

[73] Assignee: Ingersoll-Rand Co., Woodcliff Lake, N.J.

[21] Appl. No.: 457,224

[22] Filed: Dec. 26, 1989

[51] Int. Cl.[5] ..... E21B 4/14; F01L 25/04

[52] U.S. Cl. ..... 175/296; 91/317; 91/325; 173/78

[58] Field of Search ..... 175/296; 173/17, 59, 173/78, 79, 80, 139; 91/317, 318, 319, 325

[56] References Cited

U.S. PATENT DOCUMENTS

| | | | |
|---|---|---|---|
| 2,886,004 | 5/1959 | Morrison | 173/78 X |
| 2,937,619 | 5/1960 | Kurt | 175/296 X |
| 3,431,984 | 3/1969 | Buehler et al. | 173/78 |
| 4,753,302 | 6/1988 | Gien et al. | 173/80 X |

*Primary Examiner*—David J. Bagnell
*Attorney, Agent, or Firm*—Glenn B. Foster

[57] ABSTRACT

A fluid actuated percussion rock drill comprising a hollow wear sleeve and a piston slidingly disposed within the wear sleeve. Drive and return pressure surfaces bias the piston between drive and return positions, respectively. A high pressure port is included. A return chamber is exposed to the return pressure surface. A drive chamber is exposed to the drive pressure surface. A pressure sensitive valve is movable between an open and a closed position. When the valve is in the open position, the high pressure port is connected to the drive chamber. The valve includes a first valve pressure surface for exposure to the drive chamber and a second pressure surface for exposure to the high pressure port. A third valve pressure surface is exposed to an outlet pressure port. The volume of fluid travels between the high pressure port and the drive chamber when the valve is in an open position can be limited as desired for different drill applications. The use of the valve to control the high pressure into the drive chamber also results in a condition which is most desirable in a rock drill. The condition allows the high pressure port to be disconnected to the drive chamber for most of the piston return stroke, but to stay connected for most of the piston drive stroke.

28 Claims, 3 Drawing Sheets

HYBRID PNEUMATIC PERCUSSION ROCK DRILL

BACKGROUND OF THE INVENTION

This invention relates generally to rock drills and more particularly to rock drills of either the down hole or out of the hole variety.

At present there are two basic types of drills. The first is the valveless type wherein air pressure to both the drive and return chambers are controlled by the position of the piston. The drill described in U.S. Pat. No. 4,084,646 is a typical example.

The second basic type of drill is the valved type wherein air pressure to both drive and return chambers are controlled by a two position valve. The drill described in U.S. Pat. No. 2,937,619 is an example.

It is desirable in any rock drill to maximize the output power and the efficiency. The most effective way to accomplish this is to optimize the point of admission of air to the drive chamber on the piston upstroke and independently to optimize the point of closing the air supply to the drive chamber on the piston downstroke.

Valveless drills cannot do this because the points of air admission and air closing are tied to the piston position. valved drills cannot do this because they must be open to either the drive or return chamber restricting a more coefficient application of fluid to the two chambers.

The subject invention, by incorporating the conventional valveless construction on the return chamber side and a valve on the drive chamber side which independently controls both air admission and air closing, optimizing power output and efficiency.

SUMMARY OF THE INVENTION

In one embodiment of the instant invention, this is accomplished by providing a percussion apparatus including a piston displaceable between a drive position and a return position. The piston has a drive pressure surface and a return pressure surface whereby fluid pressure applied to the drive pressure surface biases the piston towards the return position and fluid pressure applied to the return pressure surface biases the piston towards the drive position. A first pressure device applies a first fluid pressure to the return pressure surface. Application of the first fluid pressure depends upon the position of the piston. A second pressure device applies a second fluid pressure to the drive pressure surface, application of the second pressure device being dependent upon pressure produced by the piston.

The foregoing and other aspects will become apparent from the following detailed description of the invention when considered in conjunction with the accompanying drawing. It is to be expressly understood, however, that the drawing figures are not intended as a definition of the invention, but are for the purpose of illustration only.

DETAILED DESCRIPTION

Figure 1:
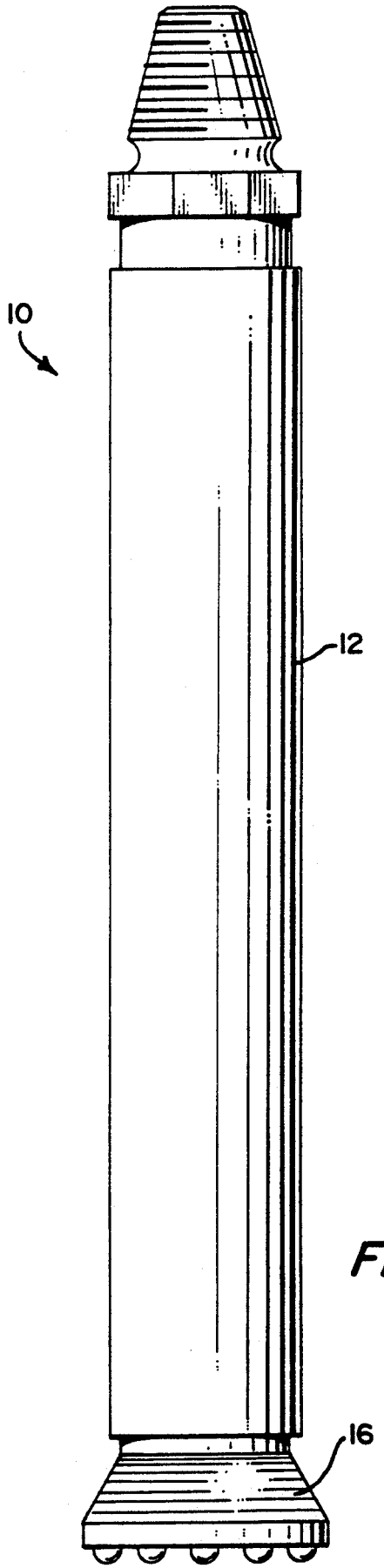
FIG. 1 is a general exterior view illustrating an embodiment of the pneumatic percussion rock drill of the instant invention.

Referring now to the drawings, FIGS. 1, 2*a*, 2*b*, 3*a* and 3*b* illustrate an embodiment of the hybrid percussion rock drill of the instant invention in which identical elements will be similarly numbered throughout the figures.

A rock drill is shown generally at 10. Even though the particular rock drill shown in the Figures is of a down the hole type, the instant invention may be similarly applied to an out of the hole rock drill. A wear sleeve 12 contains elements of the rock drill 10. A piston 14 reciprocally impacts with a bit 16 of the rock drill. The piston 14 moves in either a drive direction shown by arrow 14*a*, or a return direction shown by arrow 14*b*.

Fluid which supplies the pressure for high pressure ports 18 throughout the rock drill, providing the motive force on the piston 14, is supplied through a fluid supply line 20. A check valve 21 prevents a reverse flow of fluid from the drill through the supply line once pressure in the supply line 20 ceases.

A return chamber 22 is in fluid engagement with the high pressure port 18 via a fluid passage 24 when the piston 14 is in close proximity to the bit 16. Any pressure in the return chamber 22, biases the piston in the return direction 14*b*. The high pressure port 18 pressure continues to be applied to the return chamber until a piston passage sealing point 26 passes a wearsleeve passage sealing point 28.

An outlet pressure vent 30 is formed in the bit 16. Pressure will continue to accelerate the piston in the return direction 14*b* until a return pressure surface 32 of the piston passes an outlet 34 to the outlet pressure vent 30. At this time, any pressure in the return chamber 22 escapes to the outlet port, but the momentum of the piston continues to carry the piston in the return direction 14*b*.

Since a drive chamber 36 is exposed to the outlet pressure through vents 30 and 38, the pressure in drive chamber 36 will continue to be that of the outlet port until the end of a distributor 40 seals off a passage from the drive chamber to the outlet pressure vent 38. At this point, the fluid in the drive chamber will be compressed. This compression will increase the pressure, gradually slowing down the return travel of the piston.

A pressure sensitive valve 42 controls the fluid flow from a high pressure inlet 44 through a valve opening 56 and a passage 59 to the drive chamber 36. The valve 42 shown in FIGS. 2*a* and 2*b* contains three pressure surfaces 46, 48 and 50. The pressure surface 46 is always exposed to the pressure inlet 44 pressure. The pressure surface 48 is exposed to the drive chamber 36 pressure when the valve is closed.

When the valve is open, the pressure surface 48 can be designed to control the fluid flow between chamber 36 and the inlet 44 by controlling the dimension of the valve opening 56 and the fluid passage 59. A pressure port 52, which is exposed to pressure through vent 54 regardless of the position of the valve 42. It is anticipated that other type of pressure sensitive valves may be easily utilized in the instant application without departing from the anticipated scope of invention.

Figure 2A:
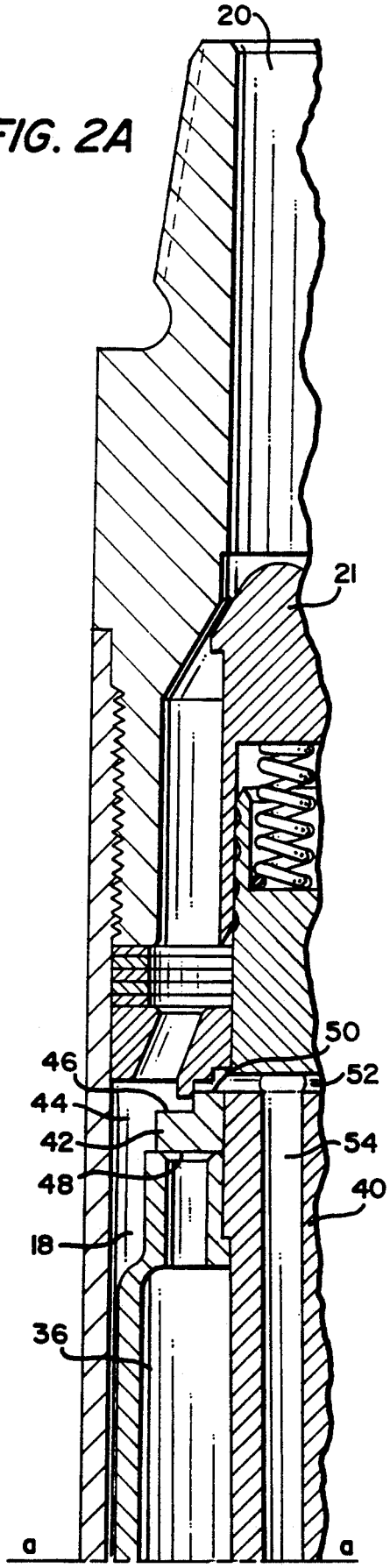
FIG. 2*a* is a sectional view illustrating an embodiment of the upper left portion of the hybrid rock drill of the instant invention, with the piston in the return position.
Figure 2B:
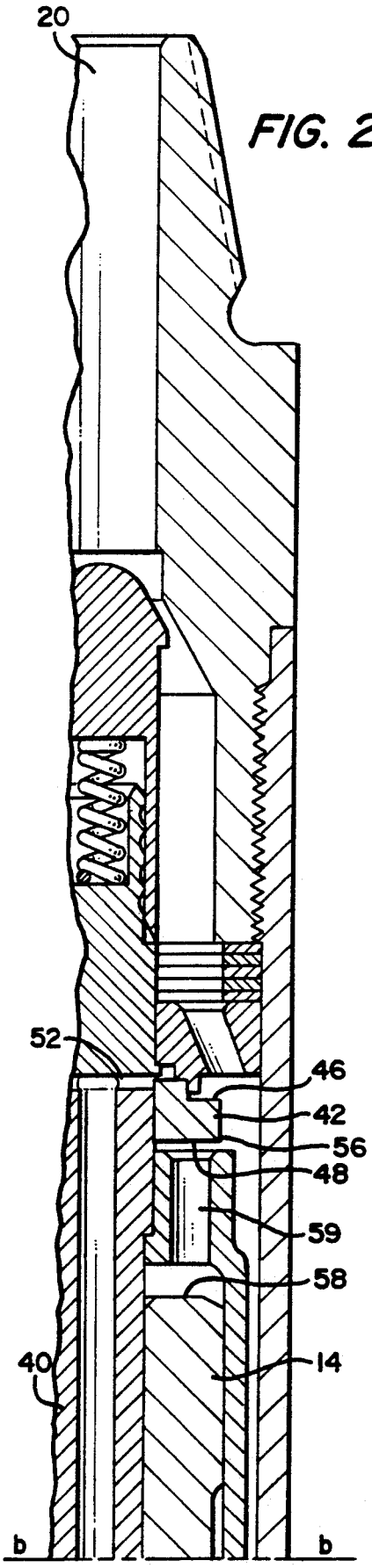
FIG. 2*b* a sectional view illustrating an embodiment of the upper right portion of the hybrid rock drill, similar to FIG. 2*a*, except with the piston in the drive position.
Figure 3A:
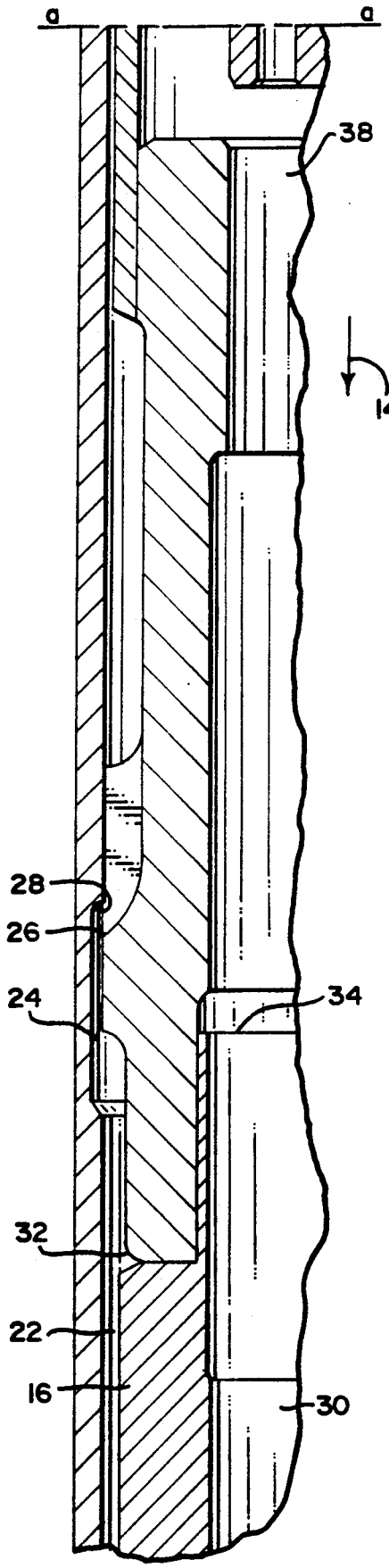
FIG. 3*a* a sectional view illustration an embodiment of the lower left portion of the hybrid rock drill of the instant invention, with the piston in the return position.
Figure 3B:
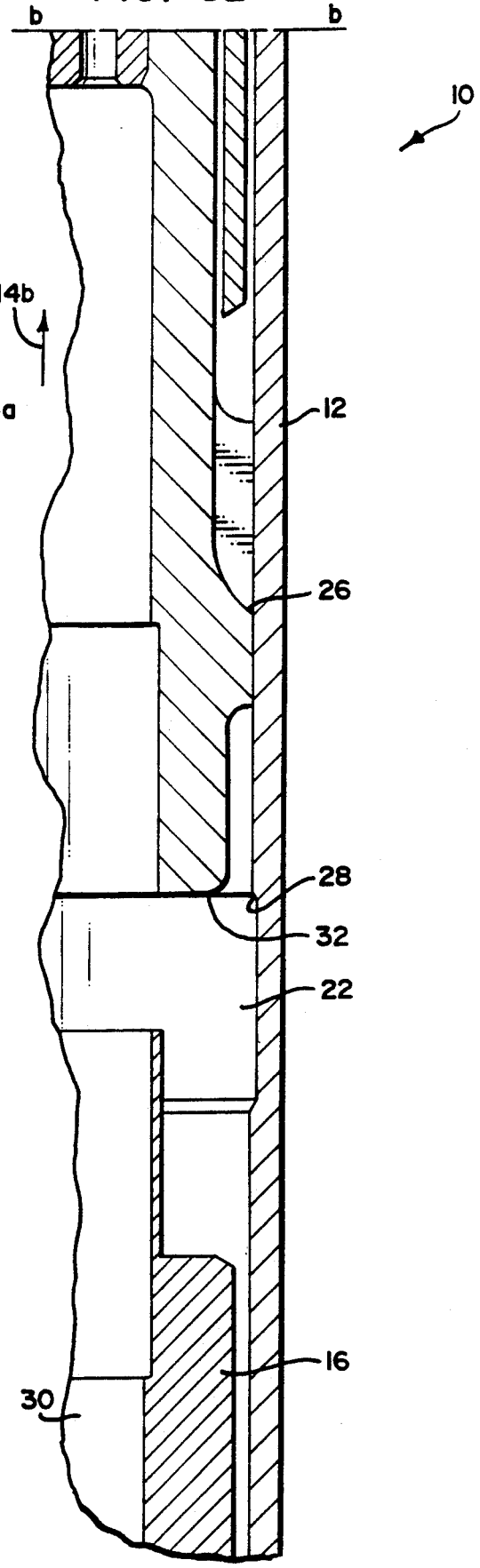
FIG. 3*b* is a sectional view illustrating an embodiment of the lower right, portion of the hybrid rock drill of the instant invention, with the piston in the drive position.

When the piston moves in the return direction 14*b* to such an extent that the force acting on pressure surface 48 exceeds the combined pressure forces acting on pressure surfaces 46 and 50, then the pressure valve 42 will open as shown in FIG. 2*b*. An open valve permits high pressure air to pass from the pressure inlet 44, through the valve opening 56 and passage 59, to drive chamber 36. The dimension of the valve opening 56, as well as the proportions of the surfaces 46 and 50, are all critical in determining at what point in the drive stroke that the valve 42 will close, as will be described later.

The resulting pressure increase in the drive chamber from the opening of the valve will first cause the return travel of the piston to halt, and then the piston will rapidly accelerate in the drive direction 14*a*. As soon as a piston drive face 58 passes the end of the distributor 40, the drive chamber will be vented to the outlet pressure through atmospheric vents 38 and 30.

Due to the vast size of the drive chamber 36, the air passing through the limited valve opening 56 will not be adequate to maintain the pressure in the drive chamber 36. As a result, the force acting on the pressure surface 48 will drop below the combined forces acting on pressure surfaces 46 and 50, and the valve will once again close.

For each given supply line 20 pressure, a drive stoke position of the piston at which the valve closes is controllable by the configuration of the valve opening 56 and passage 59, and the resultant rate at which air can flow through the opening 56. A thicker valve 42 provides a smaller valve opening, and subsequently causes the valve to close earlier in the drive stroke of the piston. For each fluid supply line 20 pressure and openings 56 and 59, there is an optimum combination of the pressure surfaces 46 and 50 which produces either the greatest drilling rate or the most efficient usage of the high pressure fluid. Quick replacement of the valve therefor results in optimization.

While this invention has been illustrated and described in accordance with a preferred embodiment, it is recognized that variations and changes be made therein without departing from the invention as set forth in the claims.

What is claimed is:

1. A fluid actuated percussion rock drill apparatus comprising:

a hollow wear sleeve;

a piston slidingly disposed within the wear sleeve;

drive and return pressure surface means for biasing the piston between return and drive positions, respectively;

a high pressure port defined within the drill apparatus;

a return chamber defined within the drill apparatus and exposed to the return pressure surface means;

a drive chamber defined within the drill apparatus and exposed to the drive pressure surface means;

a pressure sensitive valve means movable between an open and a closed position, the high pressure port being in communication with the drive pressure surface means when the valve means is in the open position, the valve means including a first valve pressure surface in communication with the drive chamber, a second valve pressure surface in communication with the high pressure port and a third valve pressure surface in communication with an outlet pressure; and means for permitting a limited volume of fluid to travel between the high pressure port and the drive chamber when the valve means is in the open position.

2. The rock drill as defined in claim 1, wherein the third valve pressure surface means is on the same side of the valve means as the second valve pressure surface means.

3. The rock drill as defined in claim 1, wherein during a compression portion of a return displacement of the piston towards the drive position, the fluid within the drive chamber is sealed from outlet pressure.

4. The rock drill as defined in claim 3, wherein a component of force exerted on the first valve pressure surface means biasing the valve in an open position, during a portion of the compression portion, will exceed the component of force applied on the second valve pressure surface means biasing the valve closed.

5. The rock drill as defined in claim 1, wherein the limited volume of fluid entering the drive chamber will be insufficient to maintain the pressure in the drive chamber to a level whereby a component of the force biasing the valve open will drop below the component of force biasing the valve closed during a portion of the displacement of the piston towards the return position.

6. The rock drill as defined in claim 1, wherein the valve may be altered dimensionally to change the rate at which the limited volume of fluid enters the drive chamber.

7. The rock drill as defined in claim 6, wherein altering the limited volume of fluid entering the drive chamber will change a point of piston travel at which the valve will close.

8. The rock drill as defined in claim 1, wherein the dimensions of the valve may be altered to change the second valve pressure surface for closing the valve.

9. The rock drill as defined in claim 8, wherein altering the second valve pressure surface of the valve will change the position of the piston travel at which the valve will close.

10. A percussion apparatus comprising:

a piston reciprocally disposed within the percussive apparatus between a drive position and a return position, the piston having a drive pressure surface and a return pressure surface whereby fluid pressure applied to the drive pressure surface biases the piston towards the return position and fluid pressure applied to the return pressure surface biases the piston towards the drive position;

a first pressure means for applying a first fluid pressure to the return pressure surface, application of the first fluid pressure being dependent upon the position of the piston relative to the percussion apparatus; and a second pressure means for applying a second fluid pressure to the drive pressure surface, application of the second fluid pressure being dependent upon pressure produced by the piston, wherein the first pressure means and the second pressure means operate independently.

11. The percussion device as described in claim 10, wherein the first pressure means is applied when the piston is placed in close proximity to the return position.

12. The percussion device as described in claim 10, further comprising:

a displaceable valve, the second pressure fluid being applied in response to the displaceable valve being in an open position.

13. The percussion device as described in claim 12, wherein the displaceable valve includes a valve pressure surface, the displaceable valve being biased into an open position in response to a high pressure from the piston being applied to the valve pressure surface.

14. A percussion device comprising:

a piston reciprocally disposed within the percussion apparatus between a drive position and a return position, the piston having a drive pressure surface and a return pressure surface whereby fluid pressure applied to the drive pressure surface biases the piston towards the return position and fluid pressure applied to the return pressure surface biases the piston towards the drive position;

a first pressure means for applying a fluid pressure to the return pressure surface depending on the position of the piston relative to the percussion apparatus; and a second pressure means for applying fluid pressure to the drive pressure surface depending upon pressures applied from a displaceable valve, wherein the first pressure means operates independently from both said displaceable valve and said second pressure means.

15. The percussion device as described in claim 14, wherein the first pressure means is applied when the piston is placed in close proximity to the return position.

16. The percussive device as described in claim 14, further comprising:

a displaceable valve including a valve pressure surface, the displaceable valve being biased into an open position in response to a high pressure from the piston being applied to the valve pressure surface.

17. A percussion apparatus including a piston displaceable between a drive position and a return position, the piston having a drive pressure surface and a return pressure surface whereby fluid pressure applied to the drive pressure surface biases the piston towards the return position and fluid pressure applied to the return pressure surface biases the piston towards the drive position, the improvement comprising:

a first pressure means for applying a first fluid pressure to the return pressure surface, application of the first fluid pressure being dependent upon the position of the piston relative to the percussion apparatus; and a second pressure means for applying a second fluid pressure to the drive pressure surface, the application of the second fluid pressure being dependent upon pressure produced by the piston, wherein the first pressure means and the second pressure means operate independently.

18. A fluid actuated percussion apparatus comprising:

piston means for sliding movement within the percussion apparatus;

drive and return pressure surface means for biasing the piston means between return and drive positions, respectively;

a high pressure port defined with the percussion apparatus;

a return chamber defined within the percussion apparatus and exposed to the return pressure surface means;

a drive chamber defined with the percussion apparatus and exposed to the drive pressure surface means;

a pressure sensitive valve means movable between an open and a closed position, the high pressure port being in communication with the drive pressure surface means when the valve means is in the open position, the valve means including a first valve pressure surface in communication with the drive chamber, a second valve pressure surface in communication with the high pressure port and a third valve pressure surface in communication with an outlet pressure; and means for permitting a limited volume of fluid to travel between the high pressure port and the drive chamber when the valve means is in the open position.

19. A fluid actuated percussion apparatus comprising:

a pressure sensitive valve means movable between an open and a closed position, and when the open position the valve means permits fluid communication between a high pressure port and a drive pressure surface of an associated piston, the valve means including a first valve pressure surface in fluid communication with a drive chamber defined within the percussion apparatus, the valve means also including a second valve pressure surface in fluid communication with the high pressure port, and the valve means further including a third valve pressure surface in fluid communication with an outlet pressure; and means for permitting a limited volume of fluid to travel between the high pressure port and the drive chamber when the valve means is in the open position.

20. The percussion apparatus described in claim 19, wherein the third valve pressure surface means is on the same side of the valve means as the second valve pressure surface means.

21. The percussion apparatus described in claim 19, wherein during a compression portion of a return displacement of the piston towards the return position, the fluid within the drive chamber is sealed from the outlet pressure.

22. The percussion apparatus described in claim 21, wherein a component of force exerted on the first valve pressure surface means biasing the valve in an open position, during a portion of the compression portion, will exceed the component of forces applied on the second valve pressure means biasing the valve closed.

23. The percussion apparatus described in claim 19, wherein the limited volume of fluid entering the drive chamber will be insufficient to maintain the pressure in the drive chamber to a level whereby a component of the force biasing the valve open will drop below a portion of the displacement of the piston towards the drive position.

24. The percussion apparatus described in claim 19, wherein the valve may be altered dimensionally to change the rate at which the limited volume of fluid enters the drive chamber.

25. The percussion apparatus as described in claim 24, wherein altering the drive chamber will change a point of piston travel at which the valve will close.

26. The percussion apparatus as described in claim 19, wherein the dimensions of the valve may be altered to change the second valve pressure surface for closing the valve.

27. The percussion apparatus as described in claim 26, wherein altering the second valve pressure surface of the valve will change the position of the piston travel at which the valve will close.

28. In a fluid actuated percussion apparatus including a piston fluid actuated to slide between first and second positions in response to fluid pressure acting on first and second pressure surfaces of the piston, the improvement comprising:

a pressure sensitive valve means movable between an open and a closed position, and when in the open position the valve means permits fluid communication between a high pressure port and the first pressure surface of the piston, the valve means including a first valve pressure surface in fluid communication with a drive chamber defined within the percussion apparatus, the valve means also including a second valve pressure port in fluid communication with the high pressure port and the valve means further including a third valve pressure surface in fluid communication with an outlet pressure; and means for permitting a limited volume of fluid to travel between the high pressure port and the drive chamber when the valve means is in the open position.

* * * * *